United States Patent [19]

Howard et al.

[11] Patent Number: 4,827,308

[45] Date of Patent: May 2, 1989

[54] PROCESS UNIT FOR AN IMAGING APPARATUS

[75] Inventors: Alan C. R. Howard, Westoning; David M. Newbury, Welwyn Garden City, both of England

[73] Assignee: Xerox Corporation, Stamford, Conn.

[21] Appl. No.: 131,075

[22] Filed: Dec. 10, 1987

[30] Foreign Application Priority Data

Dec. 15, 1986 [GB] United Kingdom ..... 8629942

[51] Int. Cl.[4] ..... G03G 15/00

[52] U.S. Cl. ..... 355/271; 355/274

[58] Field of Search ..... 355/3 R, 3 CH, 3 DR, 355/14 CH, 3 SH, 3 TR; 250/324–326

[56] References Cited

U.S. PATENT DOCUMENTS

| | | | |
|---|---|---|---|
| 3,985,436 | 10/1976 | Tanaka et al. | 355/8 |
| 4,462,677 | 7/1984 | Onoda | 355/3 R |
| 4,470,689 | 9/1984 | Nomura et al. | 355/3 R |
| 4,511,237 | 4/1985 | Kawata et al. | 355/3 R |
| 4,530,588 | 7/1985 | Kimura et al. | 355/3 DR |
| 4,540,268 | 9/1985 | Toyono et al. | 355/3 R |
| 4,583,844 | 4/1986 | Honda | 355/3 DR |
| 4,607,941 | 8/1986 | Honda | 355/3 R |
| 4,609,276 | 9/1986 | Mitzutani | 355/3 R |

FOREIGN PATENT DOCUMENTS

| | | | |
|---|---|---|---|
| 61-97663 | 5/1986 | Japan | 355/3 R |
| 61-251868 | 11/1986 | Japan | 355/3 SH |

*Primary Examiner*—R. L. Moses

[57] ABSTRACT

A process unit which can be removably mounted in a main assembly of an electrostatographic copying machine. The unit comprises a housing enclosing an imaging member and, optionally, other processing means such as a development device, a cleaner, and a charge corotron. The transfer corotron, for transferring a toner image from the photoreceptor to a copy sheet is incorporated in the cassette housing, thus avoiding the need to provide a separate movable cover to protect the imaging member from contamination, physical damage, and light exposure when the cassette is removed from the main assembly of the copier.

8 Claims, 4 Drawing Sheets

PROCESS UNIT FOR AN IMAGING APPARATUS

CROSS REFERENCE TO RELATED APPLICATIONS

Reference is made to the following copending applications filed concurrently herewith: Application Ser. No. 131,163 entitled "Process Unit Incorporating A Charging Device" in the name of Alan C. R. Howard et al.; Application Ser. No. 131,162 entitled "Process Unit For an Imaging Apparatus" in the name of Robert A. Carter Application Ser. No. 131,074 entitled "Process Unit For An Imaging Apparatus" in the name of Alan C. R. Howard et al; Application Ser. No. 130,920 entitled "Electrostatographic Reproducing Machine and Process Unit Therefore" in the name of David M. Newbury; Application Ser. No. 131,073 entitled "Fiber Traps in Copiers" in the name of Philip R. Thompson. Reference is also made to copening Application Ser. No. 038,093 entitled "Process Unit For An Imaging Apparatus" filed Apr. 14, 1987 in the name of Robert A. Carter.

BACKGROUND OF THE INVENTION

This invention relates to a process unit adapted to be removably mounted in a main assembly of an electrostatographic copying machine, the unit comprising a housing and an imaging member inside the housing. The invention also relates to an electrostatographic copying machine employing such a process unit.

In the art of electrostatographic copying there is a trend to incorporate the imaging member, i.e. the photoreceptor, together with other process means such as a charge corotron, a development device, and a cleaning device in a removable process unit or so-called cassette as disclosed for example, in U.S. Pat. No. 3,985,436. The use of such a cassette enables the easy replacement of those parts of the copying machine which are most likely to deteriorate with use, especially the photoreceptor, but also the development and cleaning systems as well as the charge corotron wire. A further advantage of containing the major process elements within a cassette is that interchangeable cassettes may be used in a given copying machine to provide different development characteristics or different colored development.

A problem with the cassette disclosed in U.S. Pat. No. 3,985,436 is that when it is removed from the main assembly of the copying machine the part of the imaging member where image transfer occurs in the copying machine is unprotected and is therefore susceptible to damage or contamination, and also to light exposure which can result in premature deterioration of the photosensitive material on the imaging member. Needless to say, these adverse affects are likely to impair the quality of image formation.

PRIOR ART

With a view to overcome this problem it has been proposed to provide a cassette with a retractable cover for shielding and protecting the imaging member. For example U.S. Pat. No. 4,470,689 to Nomura et al discloses a cassette with a movable cover mounted below the cassette housing, but integral therewith. An actuating device is included whereby the cover is automatically rotated to a closed position to shield the imaging member when the cassette is removed from the main assembly of the copying machine, and when the cassette is inserted into the main assembly the cover is automatically rotated to an open position to expose the imaging member at the area where image transfer occurs. The arrangement is such that the cover remains open during normal operation. of the machine. A similar protection cover for a process unit is described in U.S. Pat. No. 4,462,677 to Onoda wherein the cover is moved from a protective position to an open position in response to another operation of the main apparatus such as for example opening the machine to remove a paper jam. These arrangements suffer the drawback that they employ relatively elaborate mounting and actuating mechanisms for the covers which are likely to result in increased cost and diminished reliability.

In U.S. Pat. No. 4,609,276 to Mitzutani there is disclosed a copying machine employing a process cassette, wherein a guide member is present in the main assembly of the machine for guiding copy sheets into contact with the imaging member in the vicinity of the transfer corotron when the cassette is inserted in its operative position in the main assembly. The guide is necessarily disposed in close proximity, e.g. 1 to 2 mm, from the imaging member in order to prevent the developed toner image on the imaging member from being unduly disturbed, e.g. by scattering, when it is transferred to a copy sheet. Because of its very close proximity to the imaging member at least part of the guide member is hingedly mounted on the main assembly of the machine so that it can be pivoted out of the way whenever the process unit is inserted into or removed from the main assembly to avoid causing physical damage to the highly sensitive imaging member. In addition FIGS. 10A through 10G illustrate several alternative arrangements for a process unit to contain various process means. FIG. 10G illustrates a unit which in addition to including an imaging drum, charging device and developer also includes a transfer discharger and a protective cover. In this regard attention is also directed to the discussion in U.S. Pat. No. 4,462,677 to Onoda of FIGS. 13A to 13F at column 8, lines 35 to 64 and U.S. Pat. No. 4,470,689 to Nomura et al of FIGS. 15A to 15F at column 8 lines 15 to 45 concerning the inclusion of a transfer discharger in the process unit.

SUMMARY OF THE INVENTION

According to a first aspect of the present invention there is provided a process unit adapted to be removably mounted in a main assembly of an electrostatographic copying machine, the unit comprising a housing, an imaging member inside the housing, and a charging device for transferring an image from the imaging member to a copy sheet, the transfer charging device forming part of said housing.

Inclusion of the transfer charging device as part of the housing of the process unit has the advantage that the charging device itself shields and protects the imaging member from light exposure, damage, and contamination even when the unit is removed from the main assembly of the copying machine, thus dispensing with the need for a separate protection cover.

An additional advantage of having the transfer charging device integral with the unit housing is that the transfer charging device will be replaced automatically whenever the process unit is exchanged for a fresh one without having to change the transfer charging device separately.

As the transfer charging device is incorporated into the process unit a copy sheet has to be able toenter the process unit in order to have an image transferred thereto from the imaging member. For this purpose an aperture is provided in the process unit housing, preferably adjacent the transfer charging device. It is noted however that this aperture merely provides an entrance for the copy sheet and as such may be formed by a relatively narrow slot. In fact the slot may be so narrow that it can be left uncovered while still affording adequate protection for the photoreceptor. Alternatively, a simple resilient cover member may be provided which is readily displaced by the action of an entering copy sheet bearing against it as disclosed and claimed in our copending Application Ser. No. 131,162.

In one embodiment, a guide member formed integrally with the housing is also included for guiding copy sheets to the aperture. This guide member may comprise an extended portion of the transfer charging device.

According to a further aspect of the invention there is provided an electrostatographic copying machine employing a process unit in accordance with the first aspect of the invention.

BRIEF DESCRIPTION OF THE DRAWINGS

An embodiment of the invention will now be described, by way of example, with reference to the accompanying drawings in which.

It is noted that for the sake of clarity of Figures are not drawn to scale. In particular, in FIG. 2, the dimensions in the vertical direction have been exaggerated. The same features are denoted by the same reference numerals in each of the Figures.

DETAILED DESCRIPTION OF THE INVENTION

Figure 1:
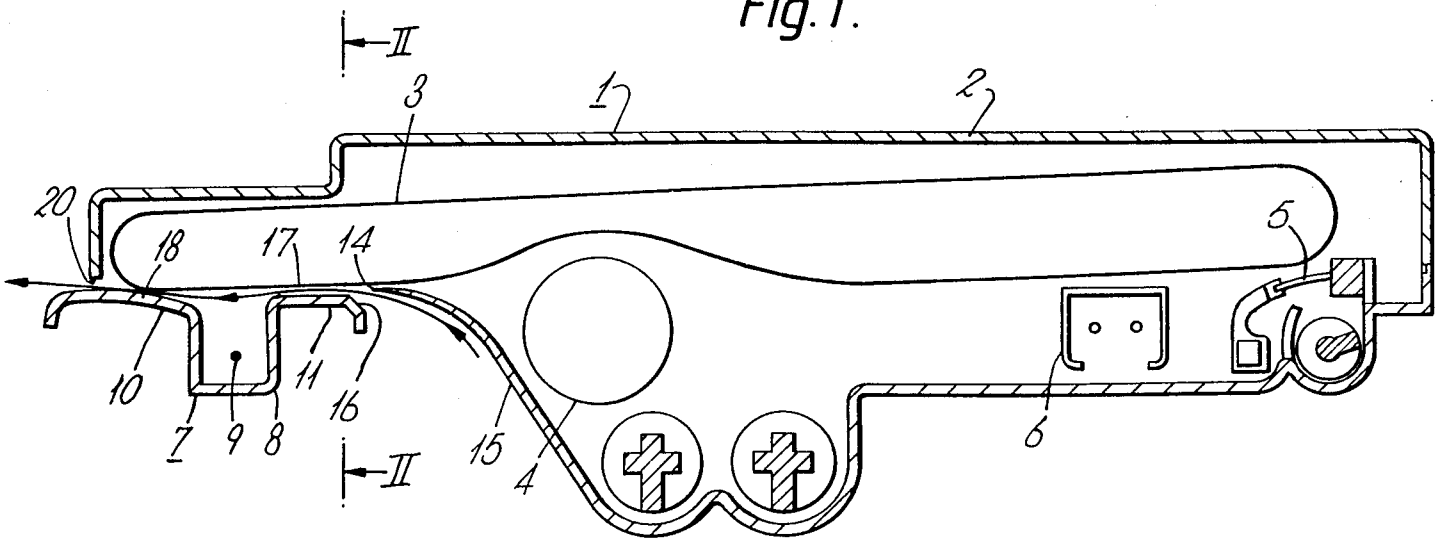
FIG. 1 is a schematic cross section of a process unit having an integral transfer coroton in accordance with the invention.

The process unit or cassette 1 shown in FIG. 1 is designed to be removably mounted in the main assembly of a xerographic copier as described, for example, in the aforementioned U.S. Patents and also in our copending U.S. Pat. Application No. 038,093 filed Apr. 14, 1987.

The cassette 1 comprises a housing 2 made for example, primarily of polystyrene which encloses an imaging member in the form of a belt photoreceptor 3 in addition to various process means, in particular a development device 4, a cleaner 5, and a charge corotron 6. The belt photoreceptor is an endless flexible belt 3 having a photosensitive surface. In the arrangement shown, when the cassette 1 is removed from the main assembly of the copier the belt is only loosely retained in the cassette, but when the cassette is inserted into the main assembly of the copying machine the photoreceptor belt is supported in an operative position by a member (not shown) forming part of the main assembly. A cassette having this kind of loosely retained photoreceptor arrangement forms the subject of our copending U.S. Pat. Application No. 038,093 to which reference is invited for further details.

Returning to FIG. 1, a transfer charging device 7 is included in the cassette housing in the vicinity of the photoreceptor belt at the area where a toner image is to be transferred from the belt to a copy sheet. The technique of actually transferring a toner image is well known to those skilled in the art and no further details need to be given here. The transfer charging device 7 is in the form of a corotron having an outer shield 8 which, as is conventional, is substantially U-shaped and made for example of stainless steel. A corona wire 9 extends the full length of the shield 8 and is spaced apart from the walls thereof in the usual manner.

At its upper end the shield has extended portions 10 and 11 on its left- and right-hand sides respectively, as viewed in the drawing. These portions 10 and 11 define the path which a copy sheet follows as it passes through the cassette for the purposes of having a toner image transferred thereto, as described in more detail below.

Figure 2:
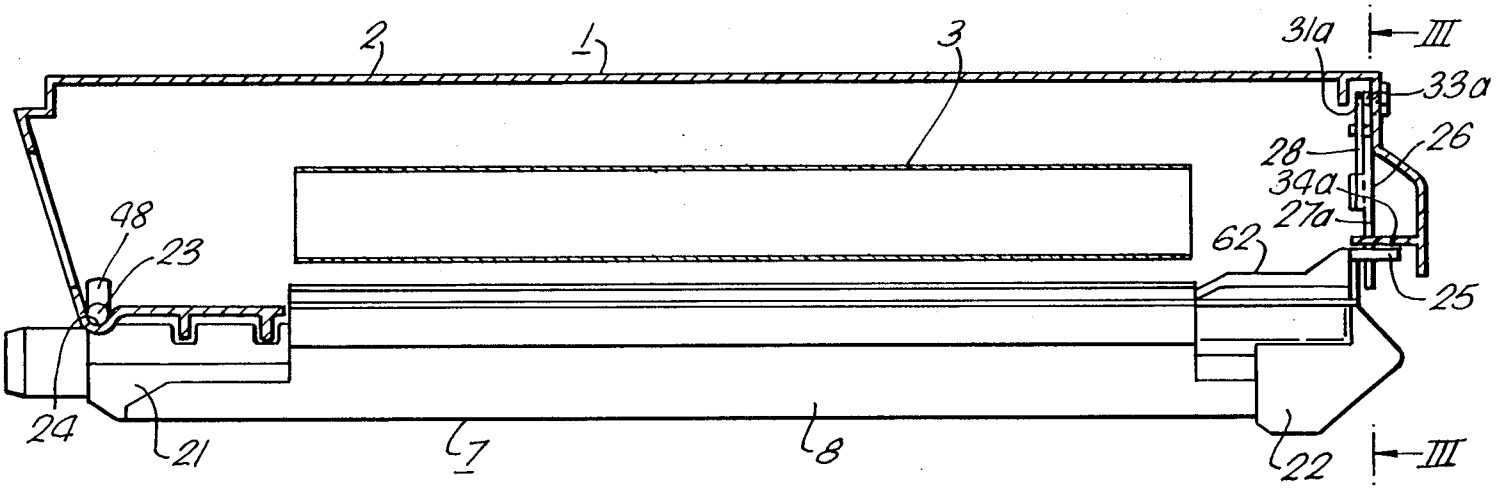
FIG. 2 is a schematic cross section of the process unit taken on the line II—II in FIG. 1.
Figure 3:
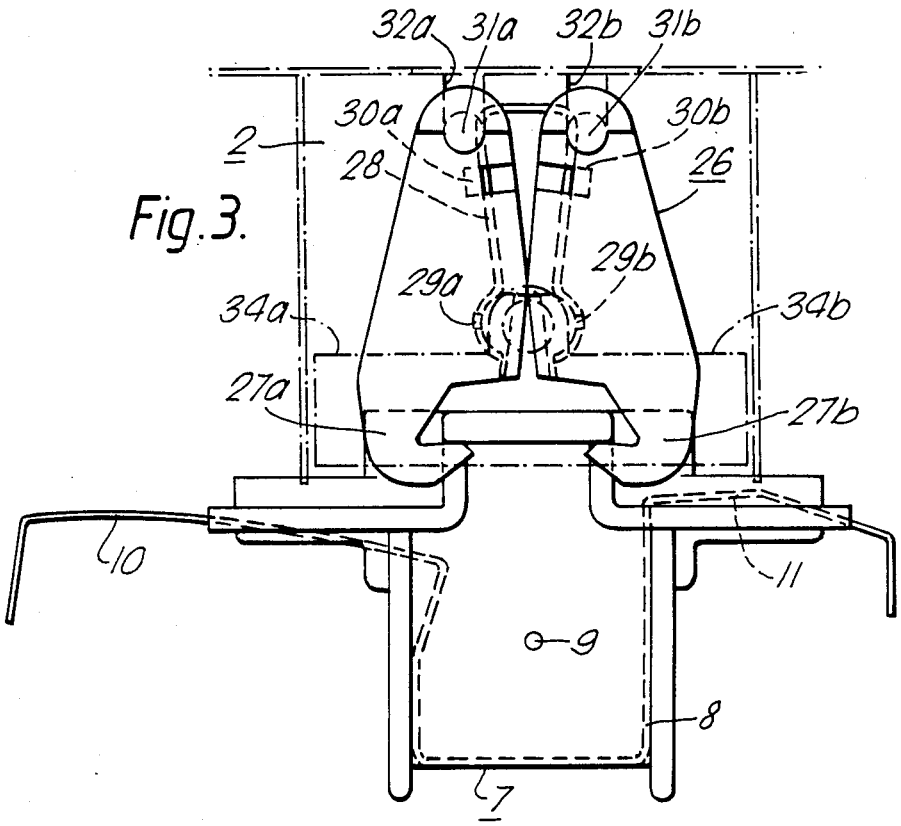
FIG. 3 is s cross section showing detail of a latch mechanism for retaining the corotron in the process unit taken on the line III—III in FIG. 2.
Figure 4:
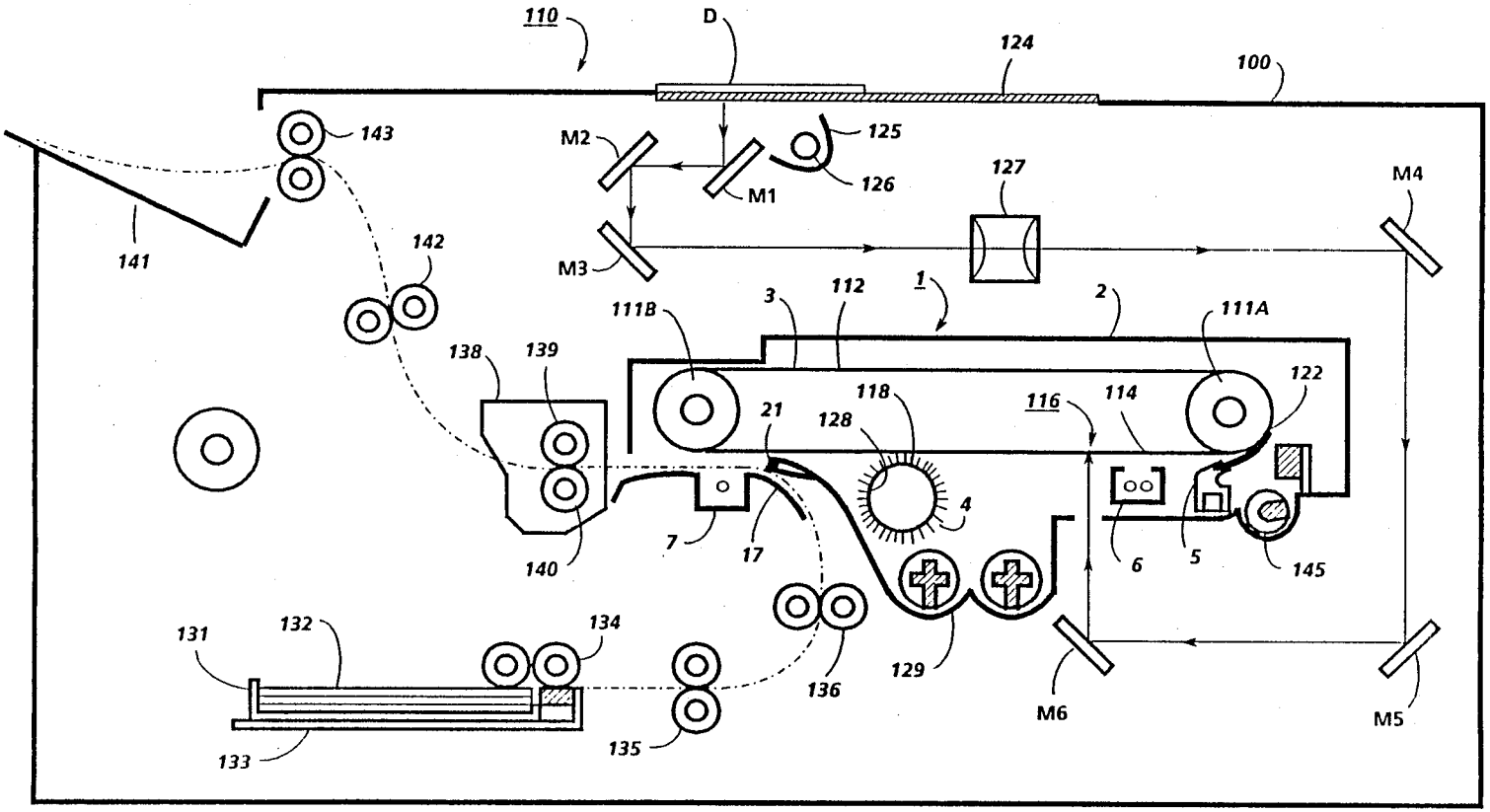
FIG. 4 is a schematic view in cross section of a reproducing machine having a process cassette according to the present invention.

The manner in which the transfer corotron 7 is fixed to the cassette housing 2 will now be described. As shown in FIG. 2, the corotron 7 has end caps 21, 22 fastened to opposite ends of shield 8. The end caps 21, 22 are made of a plastics material. End cap 21 has a projecting pin extending from its side faces both into and out of the plane of FIG. 2. The pin 23 is accommodated in sockets 24 formed integrally in the cassette housing 2. Two such sockets 24 are provided, one on each side of the end cap 21. At the opposite end of the corotron 7, the other end cap 22 has a projecting tab 25 which engages in a latch mechanism 26 as shown more clearly in FIG. 3. The tab 25 is held by two jaws **27*a*, 27*b* of the latch which are biased together by an inverted keyhole-shaped spring 28. The spring 28 is held in place by pairs of tabs 29*a*, 29*b*, 30*a*, 30*b* formed integrally on the inward face of the jaws 27*a*, 27*b*. The upper portion of each jaw 27*a*, 27*b* is provided with a protruding post 31*a*, 31*b* with an enlarged head 33*a*, 33*b* extending from the outward face. The posts 31*a*, 31*b* are accommodated in slots 32*a*, 32*b* respectively in the cassette housing, thus providing a pivotal mounting for the jaws. The enlarged heads 33*a*, 33*b* which act to retain the latch in its own plane are present on the outside of the cassette housing as can be seen most clearly in FIG. 2. The latch is also held in place by two bail bars 34*a*, 34*b* formed on a recessed portion of the internal wall of the cassette housing 2. The bail bars 34*a*, 34*b* are both joined to the cassette housing at each of their two ends, thereby providing a slot between the bars and the cassette housing through which the jaws 27*a*, 27*b* are threaded, threreby limiting their pivotal movement as well as holding them in their own plane (see FIG. 3). When the cassette is outside the main assembly of the copying machine the jaws 27*a*, 27*b* of the latch 26 are closed to support the corotron as shown in FIG. 3. However, the latch is adapted to be opened automatically to release the corotron when the cassette is inserted into the main assembly of a copying machine, which enables the corotron to be located accurately relative to the photoreceptor when it is in the operative position in the machine and also enables the corotron to be hinged open about pivot pin 23 to allow for clearance of jammed copy sheets. These features are the subject of our above referenced copending patent applications to which reference is invited for further details. It is noted, however, that it is not necessary for the transfer corotron 7** to have a hinge and latch mounting as described above. Instead, the transfer corotron 7 may, for example simply be fixed rigidly at each of its two ends to the side walls of the cassette housing 2.

As can be seen from FIGS. 1 and 2, the outside of the corotron shield 8 forms part of the external wall of the housing 2.

An aperture 14 is present between the right-hand extension 11 of corotron shield 8 and the main part of the cassette housing to enable a copy sheet to enter the process unit for the purpose of transferring an image thereto from the photoreceptor belt 3 in the vicinity of the transfer corotron when the cassette is inserted into the main assembly of the copying machine. The aperture 14 is in the form of a slot extending substantially the full width of the cassette but being relatively narrow, for example 2 mm wide. Thus the slot is sufficiently wide to permit a copy sheet to enter the cassette, but narrow enough to provide appreciable protection for the photoreceptor from damage, contamination, and light exposure thus prolonging the useful life of the photoreceptor.

The path which a copy sheet follows as it passes through the cassette for image transfer purposes is denoted by an arrow in FIG. 1. The external wall portion 15 of the main part of the cassette housing is shaped so as to deflect and guide the approaching copy sheets towards the aperture 14. Furthermore, the extreme right-hand side of the extended portion 11 of corotron shield 8 has a downturned lip 16 inclined obtusely relative to the adjacent plateau portion 17. The downturned lip thus also acts to guide approaching copy sheets towards the aperture 14.

As the copy sheet enters the cassette it follows the path defined between the photoreceptor belt 3 and the plateau portion 17 of the corotron shield extension 11. The copy sheet then passes over the main part (i.e. the shield 8 and the wire 9) of the transfer corotron 7 where the toner image is transferred from the photoreceptor belt to the copy sheet itself in known manner. From there the copy sheet traverses the slightly upwardly inclined ramp 18 forming part of the shield extension 10 on the left-hand side of the corotron 7, and then to aperture 20 in the cassette housing where the copy sheets exists the cassette for further processing, in particular for the toner image to be fixed permanently to the copy sheet using techniques well known to persons skilled in the art.

Referring now to FIG. 11, there is shown schematically a xerographic printing machine 110 having the removable process unit 1 of the present invention in its operational position in the main assembly 100. The machine includes an endless flexible photoreceptor belt 3 mounted for rotation in the clockwise direction as shown about support rollers 111*a* and 111*b* to carry the photosensitive imaging surface 112 of the belt 3 sequentially through a series of xerographic processing stations, namely a charging station 114, an imaging station 116, a development station 118, a transfer station 120, and a cleaning station 122.

The charging station 114 comprises a corotron 6 which deposits a uniform electrostatic charge on the photoreceptor belt 3. The photoreceptor belt 3, the charge corotron 6, the developer device 4, the transfer corotron 7, and the blade cleaner 5 may all be incorporated in a process cassette 1 adapted to be removably mounted in the main assembly 100 of the xerographic copier as described in aforementioned copending application Ser. No. 038,093.

An original document D to be reproduced is positioned on a platen 124 and is illuminated in known manner a narrow strip at a time by a light source comprising a tungsten halogen lamp 126. Light from the lamp is concentrated by an elliptical reflector 125 to cast a narrow strip of light on to the side of the original document D facing the platen 124. Document D thus exposed is imaged on to the photoreceptor 1 via a system of mirrors M1 to M6 and a focusing lens 127. The optical image selectively discharges the photoreceptor in image configuration, whereby an electrostatic latent image of the original document is laid down on the belt surface at imaging station 116. In order to copy the whole original document the lamp 126, the reflector 125, and mirror M1 are mounted on a full rate carriage (not shown) which travels laterally at a given speed directly below the platen and thereby scans the whole document. Because of the folded optical path the mirrors M2 and M3 are mounted on another carriage (not shown) which travels laterally at half the speed of the full rate carriage in order to maintain the optical path constant. The photoreceptor 1 is also in motion whereby the image is laid down strip by strip to reproduce the whole of the original document as an image on the photoreceptor.

By varying the speed of the scan carriages relative to the photoreceptor belt 1 it is possible to alter the size of the image along the length of the belt, i.e. in the scanning direction. In full size copying, that is to say with unity magnification, the speed of the full rate carriage and the speed of the photoreceptor belt are equal. increasing the speed of the scan carriage makes the image shorter, i.e. reduction, and decreasing the speed of the scan carriage makes the image longer, i.e. magnification.

The image size can also be varied in the direction orthogonal to the scan direction by moving the lens 127 along its optical axis closer to the original document i.e. closer to mirrors M2 and M3, for magnification greater than unity, and away from the mirrors M2 and M3 for reduction, i.e. magnification less than unity. When the lens 127 is moved, the length of the optical between the lens and the photoreceptor, i.e. the image distance, is also varied by moving mirrors M4 and M5 in unison to ensure that the image is properly focused on the photoreceptor 1. For this purpose mirrors M4 and M5 are suitably mounted on a further carriage (not shown)

At the development station 118, a magnetic brush developer device with a developer roll 128 develops the electrostatic latent image into visible form. Here, toner is dispensed from a hopper (not shown) into developer housing 129 which contains a two-component developer mixture comprising a magnetically attractable carrier and the toner, which is deposited on the charged area of belt 1 by a developer roll 128.

The developed images is transferred at transfer station 120 from the belt to a sheet of copy paper according to the practive of the present invention. The copy paper is delivered into contact with the belt in synchronous relation to the image from a paper supply system 131 in which a stack of paper copy sheets 132 is stored on a tray 133. The top sheet of the stack in the tray is brought, as required, into feeding engagement with a top sheet separator/feeder 134. Sheet feeder 134 feeds the top copy sheet of the stack towards the photoreceptor around a 180° path via two sets of nip roll pairs 135 and 136. The path followed by the copy sheets through the aperture in the cassette is denoted by a broken line.

At the transfer station 120 transfer corotron 7 provides the electric field to assist in the transfer of the toner particles thereto.

The copy sheet bearing the developed image is then stripped from the belt 1 and subsequently conveyed to a fusing station 138 which comprises a heated roll fuser 139 to which release oil may be applied in known manner. The image is fixed to the copy sheet by the heat and pressure in the nip between the two rolls 139 and 140 of the fuser. The final copy is fed by the fuser rolls into catch tray 141 via two further nip roll pairs 142 and 143.

After transfer of the developed image from the belt some toner particles usually remain on the surface of the belt, and these are removed at the cleaning station 122 by a cleaner blade 5 which scrapes residual toner from the belt. The toner particles thus removed fall into a receptacle 145 below. Also, any electrostatic charges remaining on the belt are discharged by exposure to an erase lamp 146 which provides an even distribution of light across the photoreceptor surface. The photoreceptor is then ready to be charged again by the charging corotron 6 as the first step in the next copy cycle.

The patents and applications referred to herein are hereby specifically and total incorporated herein by reference.

From the foregoing it will be evident that various modifications may be made within the scope of the present invention. For example, instead of a flexible belt the imaging member may comprise a photoreceptor drum as commonly used in xerographic machines. Moreover, apart from the transfer corotron, the cassette may enclose additional or alternative processing means to those described above.

We claim:

1. A process unit adapted to be removably mounted in a main assembly of an electrostatographic reproducing the unit comprising a housing, an imaging member inside the housing, and a charging device for transferring an image from the imaging member to a copy sheet, the transfer charging device forming part of said housing.

2. A process unit as claimed in claim 1, wherein the housing has an aperture adjacent the transfer charging device through which aperture a copy sheet may enter the process unit, the housing further comprising an integral guide member for guiding the copy sheet to the aperture.

3. A process unit as claimed in claim 1, wherein the charging device shields and protects the imaging member when the unit is removed from the main assembly.

4. A process unit as claimed in claim 2, wherein the charging device is a corotron comprising a shield, the guide member being formed integrally with said shield.

5. An electrostatographic reproducing machine comprising a main assembly, and a process unit adapted to be removably mounted in said main assembly, said unit comprising a housing, an imaging member inside the housing, and a charging device for transferring an image from the imaging member to a copy sheet, the transfer charging device forming part of said housing.

6. A reproducing machine as claimed in claim 5, wherein the housing has an aperture adjacent the transfer charging device through which aperture a copy sheet may enter the process unit, the housing further comprising an integral guide member for guiding the copy sheet to the aperture.

7. A reproducing machine as claimed in claim 6, wherein the charging device is a corotron comprising a shield, the guide member being formed integrally with said shield.

8. A reproducing machine as claimed in claim 5, wherein the charging device shields and protects the imaging member when the unit is removed from the main assembly.

* * * * *